US011590554B2

(12) United States Patent
Horz

(10) Patent No.: US 11,590,554 B2
(45) Date of Patent: Feb. 28, 2023

(54) METHOD, TOOL AND ASSEMBLY FOR TIGHTLY CLOSING A RECEPTACLE, AND TIGHTLY CLOSED RECEPTACLE

(71) Applicant: TRIVIUM PACKAGING GROUP NETHERLANDS B.V., Deventer (NL)

(72) Inventor: Peter Horz, Kisselbach (DE)

(73) Assignee: TRIVIUM PACKAGING GROUP NETHERLANDS B.V., Deventer (NL)

( * ) Notice: Subject to any disclaimer, the term of this patent is extended or adjusted under 35 U.S.C. 154(b) by 363 days.

(21) Appl. No.: 15/745,155

(22) PCT Filed: Jul. 25, 2016

(86) PCT No.: PCT/IB2016/054409
§ 371 (c)(1),
(2) Date: Jun. 26, 2018

(87) PCT Pub. No.: WO2017/017588
PCT Pub. Date: Feb. 2, 2017

(65) Prior Publication Data

US 2018/0297104 A1 Oct. 18, 2018

(30) Foreign Application Priority Data

Jul. 24, 2015 (DE) ..... 102015112108.5

(51) Int. Cl.
*B65B 7/28* (2006.01)
*B21D 51/26* (2006.01)

(52) U.S. Cl.
CPC ..... *B21D 51/2661* (2013.01); *B21D 51/2653* (2013.01); *B65B 7/285* (2013.01);
(Continued)

(58) Field of Classification Search
CPC ..... B65B 7/2871; B65B 7/2878; B65B 7/285; B21D 51/2661; B21D 51/2653
(Continued)

(56) References Cited

U.S. PATENT DOCUMENTS 231,917 A 9/1880 Lenglet
3,868,808 A * 3/1975 Preston ..... B65B 7/285 53/97
(Continued)

FOREIGN PATENT DOCUMENTS

DE 2129805 12/1972
GB 723556 A * 2/1955 ..... B65B 7/2857
(Continued)

OTHER PUBLICATIONS

Yazici, Baris; International Search Report and Written Opinion; International Application No. PCT/IB2016/054409; dated Jan. 23, 2017; European Patent Office; Rijswijk, Netherlands.
(Continued)

*Primary Examiner* — Hemant Desai
*Assistant Examiner* — Mary C Hibbert-Copeland
(74) *Attorney, Agent, or Firm* — Greenberg Traurig LLP

(57) ABSTRACT

The present invention aims at closing a receptacle (1) provided with an opening (2) as tightly as possible while keeping low the amount of material required for a closure (3) used for this purpose. To this end, a tool (10) is suggested that closes the opening (2) of the receptacle (1) by means of the closure (3). The tool (10) comprises a tool plate (12) configured such that it is adapted to be introduced into the opening (2) of the receptacle (1). The tool further comprises at least one roll (11) that is arranged on the tool plate (12). The at least one roll (11) is adapted to be deflected radially outwards from a starting position into a closing position and returns to its starting position, so that a radial force can be
(Continued)

caused to act on a closure rim (4) of the closure (3) for a limited period of time, the closure rim (4) being arranged between the at least one roll (11) and the receptacle inner side (5).

25 Claims, 13 Drawing Sheets

(52) U.S. Cl.
CPC ..... *B65B 7/28* (2013.01); *B65B 7/2871* (2013.01); *B65B 7/2878* (2013.01)

(58) Field of Classification Search
USPC ..... 53/478
See application file for complete search history.

(56) References Cited

U.S. PATENT DOCUMENTS

| | | | | |
|---|---|---|---|---|
| 4,333,585 | A * | 6/1982 | Del Bon | B65D 3/10 220/276 |
| 7,721,901 | B1 | 5/2010 | Von Spreckelsen et al. | |
| 2013/0108399 | A1* | 5/2013 | Aldred | B21D 51/2653 413/6 |

FOREIGN PATENT DOCUMENTS

| | | | |
|---|---|---|---|
| GB | 723556 | A | 2/1955 |
| NZ | 305862 | | 10/1999 |
| RU | 20307 | U1 | 10/2001 |
| RU | 2225815 | C2 | 3/2004 |
| RU | 42037 | U1 | 11/2004 |
| RU | 53663 | U1 | 5/2006 |
| RU | 2397932 | C2 | 8/2010 |
| RU | 130593 | U1 | 7/2013 |
| SU | 591404 | A1 | 2/1978 |
| UA | 16065 | A1 | 8/1997 |
| UA | 20005 | A | 12/1997 |
| WO | 199631406 | A1 | 10/1996 |

OTHER PUBLICATIONS

Office Action; Russian Patent Application No. 2018100144; dated Jan. 22, 2020; Russian Federal Institute of Industrial Property; St. Petersburg, Russia.

Search Report; Russian Patent Application No. 2018100144; dated Feb. 2, 2021; Russian Federal Institute of Industrial Property; St. Petersburg, Russia.

* cited by examiner

METHOD, TOOL AND ASSEMBLY FOR TIGHTLY CLOSING A RECEPTACLE, AND TIGHTLY CLOSED RECEPTACLE

FIELD OF THE INVENTION

The invention relates to the technical field of packaging technology, in particular the field of receptacle closing, also for products to be filled that entail high demands on tightness and are sensitive to contamination.

BACKGROUND OF THE INVENTION

From the prior art, a can consisting of a metal sheet, which is closed with a membrane on one end side thereof, is known from WO 1996/31 406. Raised edge regions of the membrane are here adhesively bonded or hot-sealed to the inner side of the can wall. Such closed cans are produced by inserting a membrane into an opening of the can and by inserting a stamp. By spreading the inserted stamp, a force acts radially on the raised edge region of the membrane, the membrane being thus connected to the inner side of the can through an additional exposure to heat. In FIGS. 5a and 5b of the published application, this spreading operation is shown. The stamp consists of circumferentially arranged elements, which are pressed radially outwards against an expansion or snap ring, whereby the diameter of the latter increases. To this end, the expansion or snap ring has an axial gap, so as to allow this increase in radius. When the expansion or snap ring presses against the edge region of the membrane, the membrane area to be connected is not acted upon by a force at the location of the gap. This may lead to leakage of the closure, in particular when the gap of the expansion or snap ring spaces the position of the vertical seam, which is typically formed on cans of this type as a result of the production process. Cans that are closed according to this method are especially not suitable for highly sensitive products to be filled, such as (high-quality) coffee.

WO 1998/03 278 shows a press device consisting of a plurality of pressing parts (cf. there FIG. 3). The press device is intended to be used for the closing of cans similar to those disclosed in WO 1996/31 406. When the pressing parts are radially extended until they enter into contact with the membrane that rests on the inner side of the can, axial gaps are formed. At these gaps, no force is transmitted to the membrane. Through a plurality of planes of the pressing part gaps, a formation of channels, which inevitably occurs in WO 1996/31 406, is intended to be avoided. In particular in the area of a vertical seam of a can to be closed, an axial channel, which has a negative effect on the tightness of the can, may form between the membrane and the inner side of the can, although the gaps of the press device are staggered. In addition, only a subarea of the circumferential area of the raised edge region of the membrane is fixedly connected to the inner side of the can (only at the locations at which a force is actually radially transmitted from the press device to the membrane). Hence, the use of the press device necessitates, for the same tightness, a larger area in comparison with a device that connects the entire area of the raised part of the membrane to the can, and this leads to the necessity of using an increased amount of material and to an increase in the costs of the membrane.

SUMMARY OF THE INVENTION

Starting from the prior art, it is the object of the present invention to close receptacles as tightly as possible while keeping low the amount of material required for a closure.

This object is achieved by the tool according to the present invention that can be used in a closure assembly and that allows a receptacle to be produced according to a method.

A tool according to the present invention is suitable for closing an opening of a receptacle, e.g. a can, with a membrane. To this end, the tool comprises a tool plate having attached thereto at least one roll. When, preferably, a closure has been introduced in the opening to be closed, the tool can enter a space that is open on one side (delimited by the closure) in the interior of the receptacle. At the desired axial position within the can, the at least one roll can be deflected radially outwards, so as to apply a force to the rim of the closure and connect the rim, possibly under the influence of heat, sealingly with the inner side of the receptacle. Due to the tool's ability to rotate, the whole circumference of the rim can be connected to the inner side of the receptacle when the roll has been deflected outwards (claim 1). Due to a radial returnability of the tool, the latter can easily be removed from the receptacle, without damaging the sealingly attached closure, and a next receptacle to be closed can be provided within a short time.

A plurality of rolls attached to the circumference of the tool plate accelerate the closing of a receptacle and improve the closure result. During the rotation of a tool with deflected or extended rolls, which apply a force to a closure rim, it will then suffice when each roll covers a shorter distance and when the rotation of the tool is not a full rotation (360°) for applying a force to the entire area of the closure rim. For accomplishing sufficient tightness, it may be of advantage when each section of the closure rim is contacted more than once by one or a plurality of rolls. This results in a rotation of more than 360° or, in the case of a plurality of rolls, proportionately according to the number of rolls. Two rolls, three rolls, four rolls, five rolls, six rolls, seven rolls, eight rolls or more than eight rolls may be expedient for this purpose (claim 2). When a plurality of rolls is used, the force acting on the receptacle is partially taken up by an opposite roll and the receptacle will remain more accurately at a centered (about the longitudinal axis of the receptacle) position during the application of the tool. In this respect, it will be advantageous when, as far as possible, the rolls are simultaneously deflected and when they simultaneously contact the closure rim. In the case of a plurality of rolls, it will also be of advantage when the rolls are arranged in a circumferentially uniformly distributed or radially symmetric manner. Also an uneven number of rolls may be useful and, depending on the roil diameter relative to the receptacle diameter, also more than eight rolls may be arranged in the tool. In the following, the terms roll and rolls will be used as equivalent terms, which always refer to at least one roll.

Before an opening of a receptacle can be closed, a closure is first advantageously introduced in the opening. To this end, the tool may have arranged thereon a positioning element (claim 3), whereby a closure and the tool can be introduced in the opening of a receptacle in one operating step. This one operating step may also consist of two or more operating substeps. For example, a closure located on the positioning element may first be introduced in the opening of the receptacle by extending the element and, in a second operating substep, the tool with the rolls may follow.

The rolls are deflectable by a defined force. The rolls may be deflected pneumatically, whereby the force acting on the closure rim can be controlled easily. The rolls may also be deflected by means of pneumatic, mechanical, electric, electromagnetic actuators or by other force-generating actuators (claim 4).

The tool, also in an advantageous embodiment, may be arranged as an element of a closure assembly. The array additionally comprises at least one shaft by means of which a torque can be applied to the tool, the torque causing the tool to rotate (claim 5). Preferably, the shaft is also axially extendable, deflectable or displaceable, so as to allow the tool to be introduced into the space which is open on one side thereof, delimited by the closure, and, possibly, the inner side of the receptacle (if the closure rim should not extend up to the rim of the receptacle) (claim 6).

Furthermore, the closure assembly may comprise a lifting device (claim 7). A receptacle to be closed can be placed on this lifting device, the receptacle opening to be closed being directed towards the tool and the centerlines of the receptacle and of the tool lying advantageously on top of each other. Through an upward movement of the lifting device, the receptacle to be closed is pushed over the tool. The closure may here already have been introduced in the receptacle arranged on the lifting device or the closure may be arranged on the optional positioning element of the tool. Furthermore, the lifting device may retain a receptacle located thereon, so as to prevent the receptacle from rotating during the rotation of the tool, and/or cause the receptacle to rotate, in which case the tool in the interior of the receptacle need not, but may additionally rotate in the interior of the receptacle during the closing process. The use of a lifting device may render the axial deflectability of the shaft unnecessary. Likewise, a combination of the oppositely directed movements of the lifting device and of the shaft may be advantageous.

If the closure assembly is configured such that it comprises a heating element (claim 8), an adhesive layer on at least the rim of the closure or on the inner side of the receptacle can be softened, while the tool rotates with the rolls deflected.

Such a heating element may be arranged outside of the receptacle to be closed or in the area of the tool plate, i.e. during the closing process in the interior of the receptacle (claim 9).

The heating element is here preferably an inductive element, an electric heating element or a heat radiator element (claim 10). In the case of an inductive element, the heating element is the element from which the inductive effect originates, although, due to the mode of operation of inductive heating, the element heated is not this element, but another one. Electric elements provide the heat directly in the heat-generating element and transmit it directly. Thermal energy for softening a layer to be softened can provided by a heat radiator (e.g. infrared, laser); preferably, a heat radiator is arranged outside the receptacle in the closure assembly.

Preferably, the closure assembly may comprise a guide ring and a lifting device. The lifting device may be arranged such that a receptacle with an opening to be closed can rest thereon. Through a movement of the lifting device, the receptacle can be moved over the tool (claim 11).

Preferably, the guide ring is able to receive the receptacle therein such that the latter occupies a defined position and is able to guide the receptacle over the closure assembly under the preload of a spring (claim 12).

A receptacle closed by the tool or by the closure assembly has a closure whose closure rim is fully circumferentially connected to the receptacle inner side in a sealing fashion (claim 13). This allows a reduction of the amount of material used, while achieving the same tightness as in the case of the prior art, or an improved tightness can be provided on the basis of the same area of the closure rim. Receptacles closed by means of the tool according to the present invention or by means of the closure assembly according to the present invention are, due to their particularly high tightness or their low sensitivity to contamination, suitable for highly sensitive products to be filled, such as high-quality coffee and moist products to be filled. Such receptacles may also be used under clean room conditions (aspetic or autoclave with pressure compensation).

Preferably, the receptacles described here consist of metal, glass, plastic material or a composite material, the receptacles being, particularly preferred, three-part cans having a vertical seam that results from the production process (claim 14). Typically, three-part cans are formed from a sheet metal blank into a hollow-cylindrical shape, with two lateral edges of the reshaped sheet metal overlapping partially. The overlapping areas are typically welded together, whereby a seam is formed. A bottom element is seamed on and, optionally, the wall of the hollow cylinder is provided with stabilizing beads. Especially in the area of the vertical seam of a three-part can, the problem of tightly closing making use of a closure comprising a closure rim has hitherto not been solved in a satisfactory manner.

The closure rim may be connected to the inner side of the receptacle by means of a sealing wax or a hot glue (claim 15), which is softened e.g. via a heating element and which solidifies after having been pressed against the inner side of the receptacle and guarantees the contact between the closure rim and the inner side of the receptacle.

If the height of the closure rim is larger than the axial distance of the insertion position to the opening edge of the receptacle, a certain percentage of the closure rim will project beyond the end side of the receptacle. This projecting percentage is crimped over the end-side rim area. Preferably, the projecting percentage of the closure rim is less than 10%, less than 5%, less than 2% of the overall height of the closure rim and, particularly preferred, practically no area of the closure rim projects axially beyond the rim of the end side with the opening (claim 16).

Preferably, the closure may be connected to a receptacle wall (inner side or outer side) by means of a hot glue or a sealing wax (claim 17).

For closing an opening of a receptacle, such a receptacle is first provided, the closure is inserted or introduced into the opening of the receptacle, and the tool (e.g. a tool of the type disclosed here) is introduced into the space of the receptacle that is open on one side thereof and delimited by the closure. The at least one roll deflects radially outwards, whereby a force acts on the at least one contact point where the roll is in contact with the closure rim, thus pressing the closure rim against the inner side of the receptacle. Through a subsequent rotation of the tool and, consequently, a circumferential rolling movement of the at least one roll, a force will act on each point of the closure rim in the course of a complete rotation (360°), so that the entire closure rim will be connected to the inner side of the receptacle (claim 18). Instead of rotating the tool, the receptacle may be rotated, in which case the tool will not rotate. Likewise, it is possible that both the receptacle and the tool rotate in opposite directions.

An aspect of essential importance is that a relative rotation (circumferential relative movement) between the receptacle and the tool takes place, in order to guarantee that there will be at least one rolling movement on the closure rim around the full circumference thereof with an applied force of the at least one roll. Preferably, a plurality of rolls, e.g. two, three, four, five, six, seven, eight or more than eight rolls may be used in the case of the present method.

After having pressed on the closure rim around the full circumference thereof, the at least one roll is returned to its starting position and the tool is axially removed from the space in the receptacle above the closure. The correspondence of the axial basic shapes of the receptacle and of the closure rim includes production tolerances. The basic shapes should be as identical as possible, the radial dimension of the closure rim being slightly (less than 5%) smaller than the radial dimension of the receptacle, so as to allow the closure to be easily introduced in the receptacle.

If the closure is heat bonded or connected by means of a sealing wax to the inner side of the receptacle, the layer is thermally softened or liquefied prior to or during the rotation of the tool (claim 19). The layer may be applied in the area of the closure rim or to one side of the closure substantially in full area.

Preferably, the thermal energy is supplied to the layer by transmitting it via the at least one roll and/or the closure (claim 20).

The closure is preferably introduced in the receptacle by means of a positioning element, the positioning element being arranged on the tool (claim 21). The introduction of the closure and of the tool is, particularly preferred, executed in one operating step consisting substantially of an axial (longitudinal axis of the receptacle) movement of the tool (with the positioning element) relative to the receptacle. It is either possible that the tool changes its position and is introduced in the opening of the receptacle or that the receptacle changes its position relative to the tool and receives the latter therein.

As a result of the production process, receptacles, in particular three-part cans, have a circumferential step, the step being located at the point where two lateral edges of the sheet metal overlapped prior to welding, This often results in a step located in the receptacle, which, when seen circumferentially in a clockwise direction, represents an upwardly formed step. When seen circumferentially in an anti-clockwise direction, a downwardly formed step is obtained. Preferably, the relative rotation is executed such that the at least one roll moves in a direction opposite to an upwardly formed step (claim 22).

By means of the tool, which is adapted to be used in the closure assembly, receptacles according to the present invention can be produced in accordance with the method for closing an opening of a receptacle (claim 23).

A method for closing, which is also suggested (claim 25), can be realized by rotating the receptacle as well as by rotating the tool (or even both). To this end, the features following hereinafter are provided, among other features:

(c) axially introducing a closure tool into a space that is open on one side thereof and delimited by the closure panel (of the closure) on the opposite side thereof;

(d) deflecting at least one rotatable roll outwards, so that the at least one roll radially contacts the closure rim of the closure;

(e) applying a rotating relative movement of the tool (with the at least one roll contacting the closure rim) and the receptacle, whereby the closure rim is fastened to the receptacle inner side and the opening of the receptacle is tightly closed.

In feature (e), the closure rim can be fastened (in a strip-shaped manner) to the upper end section of the inner side of the receptacle. Or the closure is lowered further down into the inner side of the receptacle with the tool. At any rate, the opening of the receptacle can be tightly closed, or two filling chambers are formed that are configured for filling with a foodstuff or particulars, which will help to consume the foodstuff in the other filling chamber or which are indispensable for allowing such consumption.

The examples following hereinafter explain and supplement the claimed invention.

BRIEF DESCRIPTION OF THE DRAWINGS

The embodiments of the invention are shown on the basis of examples and not in a manner in which limitations from the figures are transferred to or read into the claims. Like reference numerals in the figures designate like elements.

FIG. 2*aa* and FIGS. 2*bb* and 2*cc* are more precise representations of the schemata according to FIGS. 2*a*, 2*b* and 2*c*. The elements are functionally identical and are here only shown more precisely as regards their geometry.

DETAILED DESCRIPTION OF THE INVENTION

Figure 1:
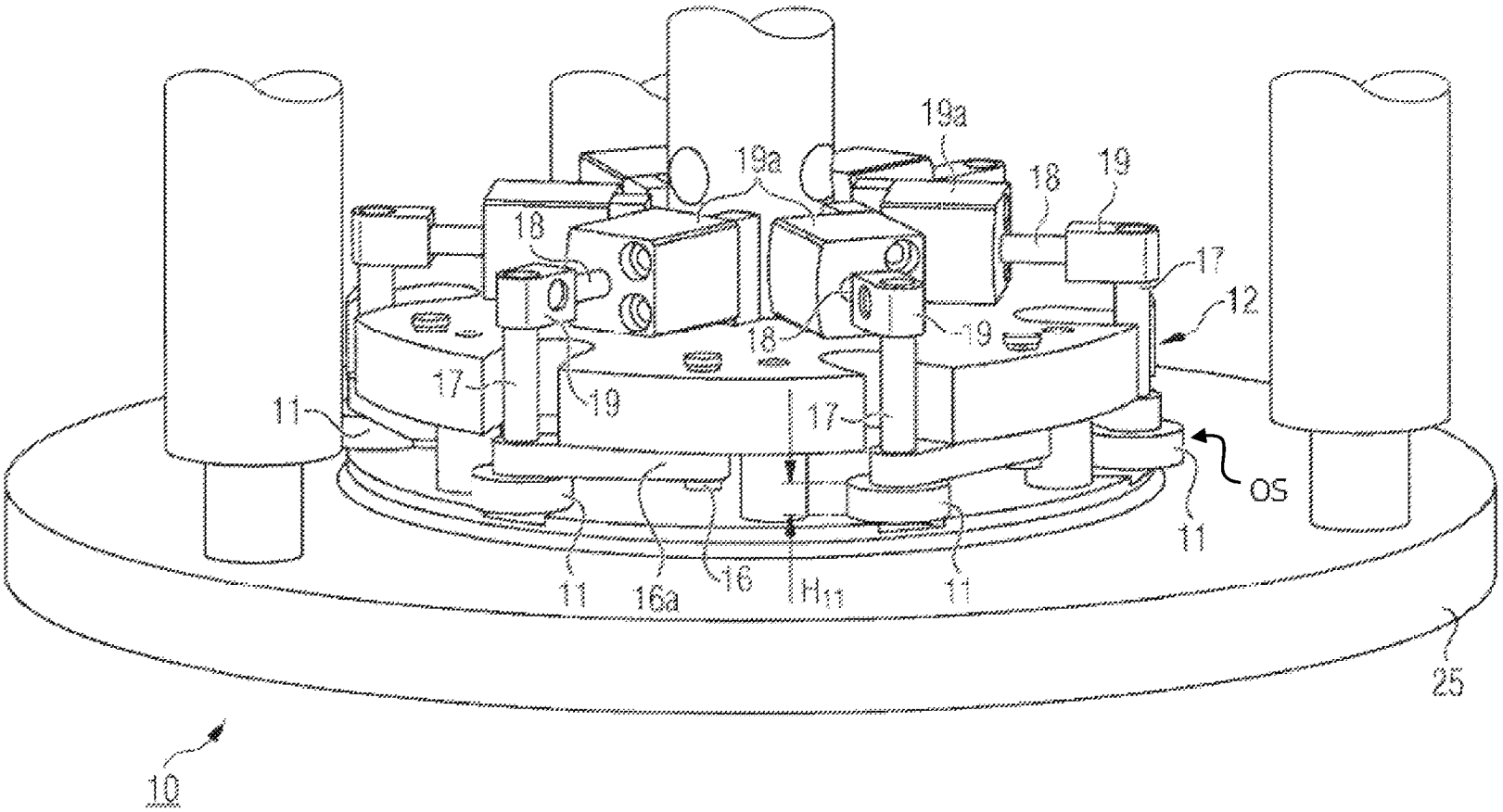
FIG. 1 shows a perspective view of a tool 10.
Figure 1A:
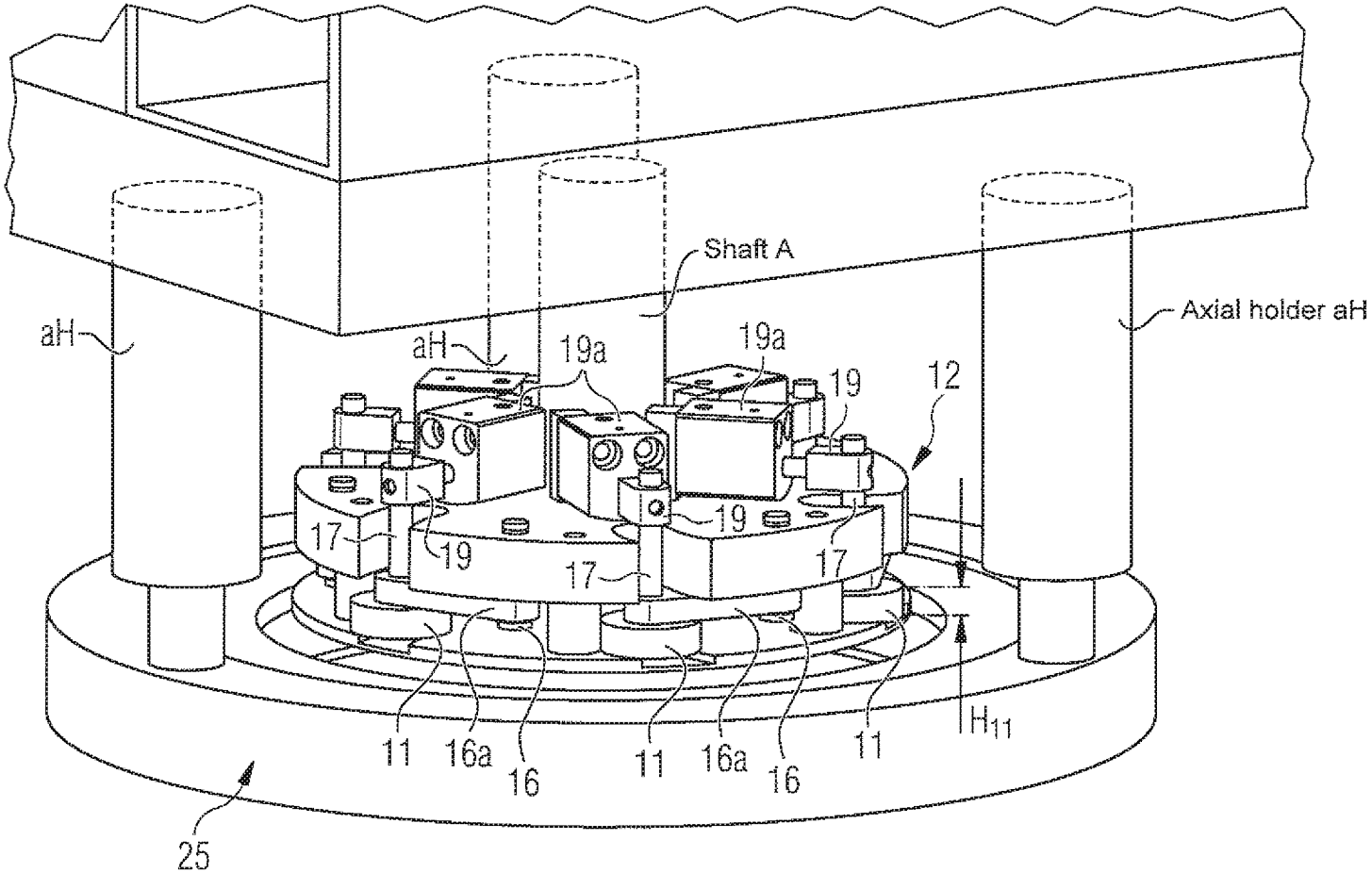
FIG. 1*a* shows a more distinct representation of the tool 10 according to FIG. 1.

An example of the present invention is the tool 1 in FIG. 1. The centering ring 25 shown in this figure is not an element of the tool 10.

In the present embodiment, the tool 10 comprises a plurality of rolls 11 which are circumferentially evenly arranged on the outer peripheral region of a tool plate 12. The rolls 11 are preferably cylindrical in shape, have an outer surface OS adapted to contact a closure rim 4 and have a height H11 that corresponds substantially to the height H4 of the closure rim 4 according to FIG. 7. Preferably, the rolls consist of a metallic material, specially preferred of a metal that can easily be heated by induction. The circumferential surfaces 11 a of the rolls 11 are preferably smooth, and they may also have applied thereto a coating, e.g. a rubber coating or the like, or the rolls are made of plastic material.

Each of the rolls 11 is connected to the tool plate 12 via a cantilever arm 16*a* and a joint 16. In addition, each of the rolls 11 is connected to a roll axle 17 along its respective longitudinal axis, the respective roll axle 17 being connected via a respective connection element 19 to a rod 18 (a plunger). A lifting device 19*a* makes each of the rods 18 extendable and retractable. For this kind of movement, the lifting device 19*a* is able to extend the rod 18 in a radial direction as well as to retract it in a negative radial direction (in the direction of the interior of the tool plate).

The movement of the respective rod 18 can be transmitted via the respective connection element 19 to the respective roll axle 17, thus allowing each roll 11 to be retracted and extended independently.

If the roll 11 is extended or deflected, a counterforce acting on the roll 11 can be taken up by the lifting device 19*a* (via the rod 18, the connection element 19 and the roll axle 17).

The respective joint 16 guides and supports the movement of the respective roll (via a connection of the cantilever arm 16*a* with the roll axle 17 and the joint 16) during extension and retraction or during the outward deflection movement and the inward deflection movement.

To the person skilled in the art it will be evident that such a tool 10 may also be configured in a different way, the aspects of the retractability and extendability of each of the rolls 11 and the possibility of taking up a force at the extended position sustain the function.

Figure 2A:
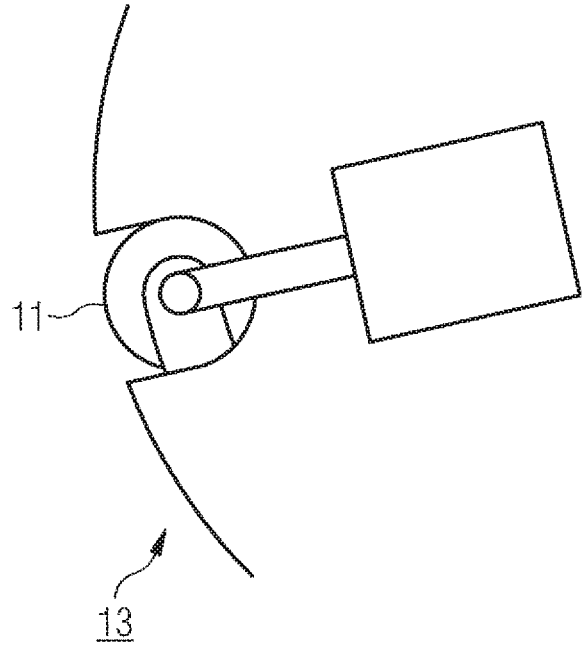
FIG. 2*a* schematically shows, in a top view, the tool 10 as a detail of an enlarged representation. A roll 11 is at a starting position 13.
Figure 2A:
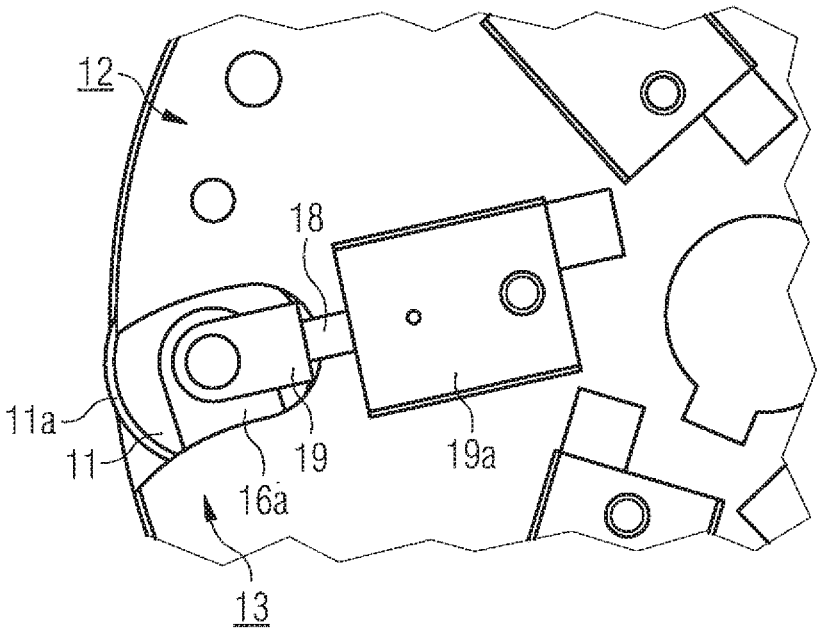
Figure 2B:
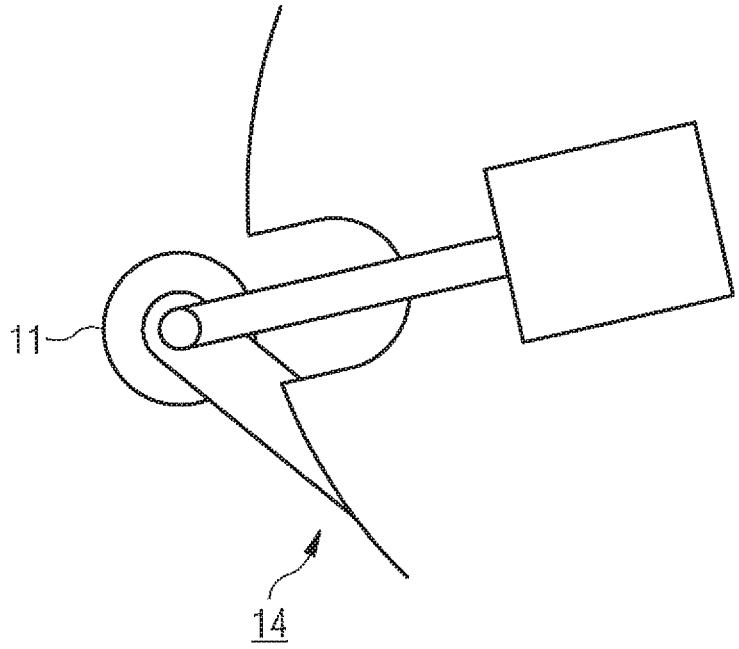
FIG. 2*b* schematically shows, in a top view, the tool 10 as a detail of an enlarged representation. A roll 11 is at a closing position 14.
Figure 2B:
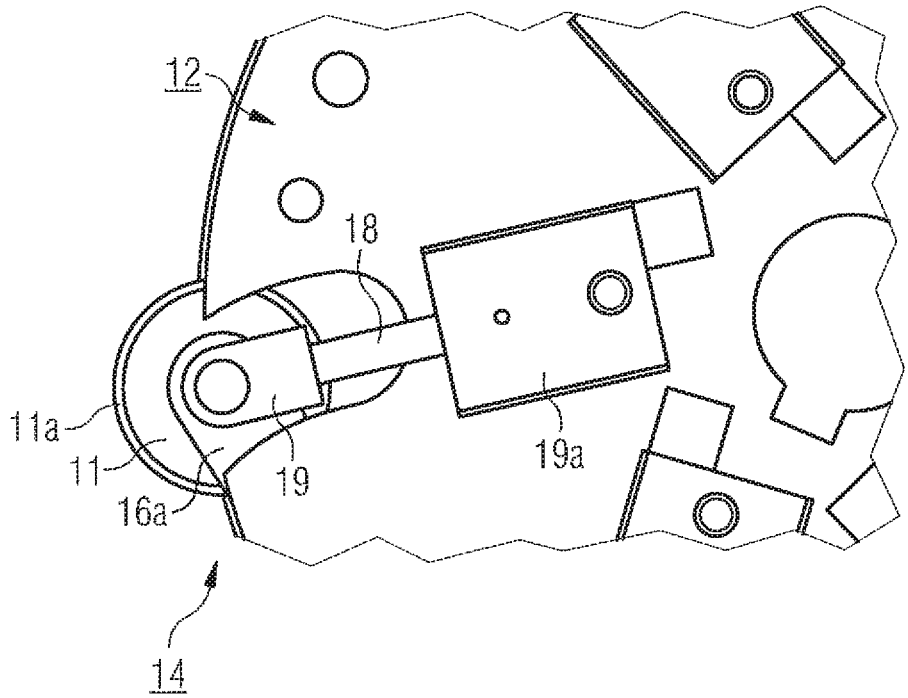

In FIGS. 2*a* and 2*b* (also FIGS. 2*aa* and 2*bb*), the working capability of the tool 1.0 is shown in a top view. At a starting position 13 (FIGS. 2*a* and 2*aa*) of the roll 11, the outermost area of the roll 11 is located radially within the outermost area of the tool plate 12. A tool can thus be introduced smoothly into a receptacle 1, the introduction of the tool 10 being realizable by a movement of the tool 10 in the direction of the receptacle 1, by a movement of the receptacle 1. in the direction of the tool 10, or by a movement of the tool 10 and of the receptacle 1 in opposite directions.

At a closing position 14 (FIG. 2*b*, 2*bb*), the roll 11 has been extended or deflected to a certain extent. This has the effect that the outermost area of the roll 11 is, at least partially, located radially outside the tool plate 12. When the tool 10 is positioned in a receptacle 1 having a closure 3 inserted therein, a force can, at this roll position, act between the roll 11 (its circumferential surface 11*a*) and the closure 3, whereby the closure 3 can be pressed with its closure rim 4 against the inner side 5 of the receptacle in the area of the closure rim 4 and the axial contact strip of the rolls 11. By rotating the tool 10, and consequently the roll 11, provided that the rolling resistance has been overcome, the contact point between the roll 11 and the closure rim 4 is displaced along the circumference, so that in the case of a full rotation of the tool 10 each point of the closure rim 4 is pressed against the inner side 5 of the receptacle. Each point of the closure rim 4 means here each point that is accessible to the roll 11.

If a plurality of rolls 11 is provided, the above paragraphs should be read in the plural.

Preferably, a layer 7 is provided between the closure rim 4 and the inner side 5 of the receptacle, the layer being configured as an adhesive layer or a connection layer.

The layer 7 may be applied to one side of the closure 3 or to the surface of the inner side 5 of the receptacle.

Preferably, the layer 7 is a sealing wax or a hot glue, particularly preferred the layer 7 comprises a material containing polyethylene and/or polypropylene. Such materials can be softened or even liquefied by heating; after having solidified or set, these materials connect the elements with which they entered into contact during softening or liquefying, i.e. the receptacle wall (inner side 5 of the receptacle and/or outer side 8 of the receptacle) and the closure rim 4.

Before or during the rotation of the tool 10 relative to the receptacle 1, the softening or liquefying is thermally caused, so that at the point where the roll 11 enters into contact with the closure rim 4, a softened or liquefied layer of material will be present. By circulating the roll 11 along the circumferential closure rim 4 with a respective flowable material, an accumulation of material or a material wave 33 will form between the closure rim 4 and the inner side 5 of the receptacle, the material wave being, due to the movement of the roll 11, pushed forward ahead of the roll in the direction of movement of the latter. Such a material wave 33 is not a distinct wave, but an area of increased thickness of the layer 7 in a flowable state (thermally softened or liquefied) in comparison with the original thickness on one side of the closure rim 4 or on the inner side 5 of the receptacle.

Figure 2C:
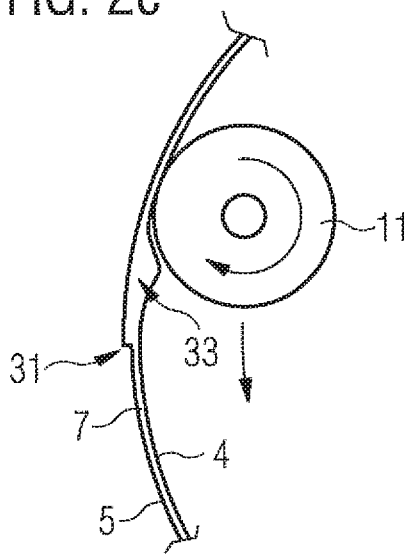
FIG. 2*c* shows, in a top view, the behavior of a layer 7 after thermal softening of the latter, with at least one roll 11 pressing the closure rim 4 against the inner side of the receptacle 5.
Figure 2C:
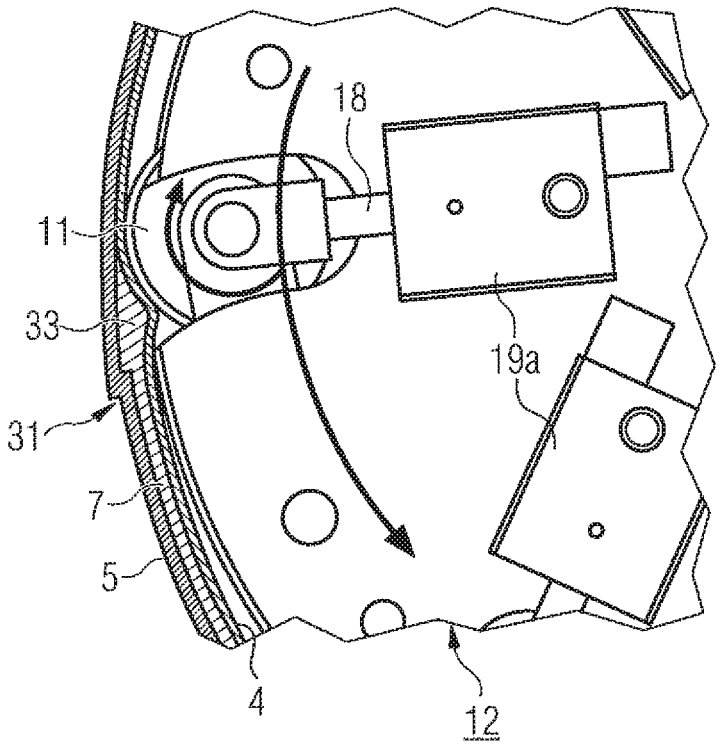

An illustrating view of this is schematically shown in Fig, 2*c*, and a geometrically more precise view is shown in FIG. 2*cc*. Due to a radially acting force, which is applied by the roll 11 to the closure rim 4, the layer 7, as a flowable material, is slightly thinner than the initially existing layer 7, after the roll 11 has passed this area. Excessive material of the layer 7 is pushed forward by the roll 11 in the form of a material wave 33 ahead of the roll. This behavior is preferably desired, since an unevenness, in particular hollows, of the inner side 5 of the receptacle can thus be leveled out by the excessive material.

According to a particularly preferred embodiment, the material wave 33 formed will fill the vertical seam 31 of a three-part can such that the closure rim 4 will be sealingly connected to the inner side 5 of the receptacle also in this sensible area. Thus, also these points will be acted upon by the roll 11, as has been mentioned hereinbefore.

Preferably, the roll 11 moves in the direction of the vertical seam 31, in the case of which a step in this area represents a step formed upwards when seen in the direction of the roll 11 (the roll moves e.g. in a circumferential direction, the step of seam 31 rises in front of the roll in a negative r-direction). The opposite direction, in which an area formed as a downward step when seen in the direction of the roll 11, is sealed or adhesively bonded, is possible as well.

This effect is also desired when glass receptacles are sealed, such glass receptacles having typically a longitudinal seam that results from the production process.

Figure 3:
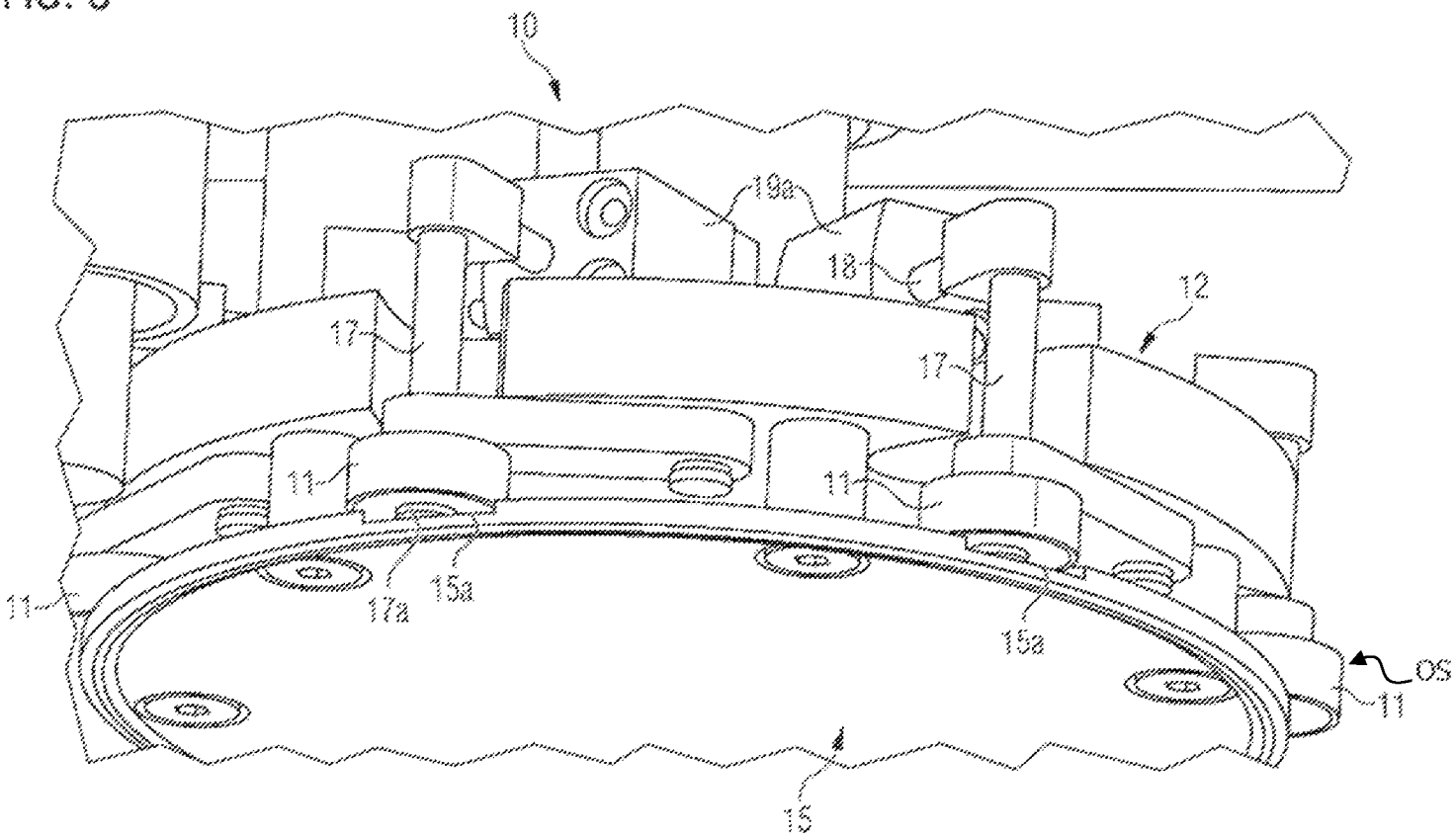
FIG. 3 shows a perspective representation of a tool 10 obliquely from below, with a positioning means 15 for the closure.
Figure 3A:
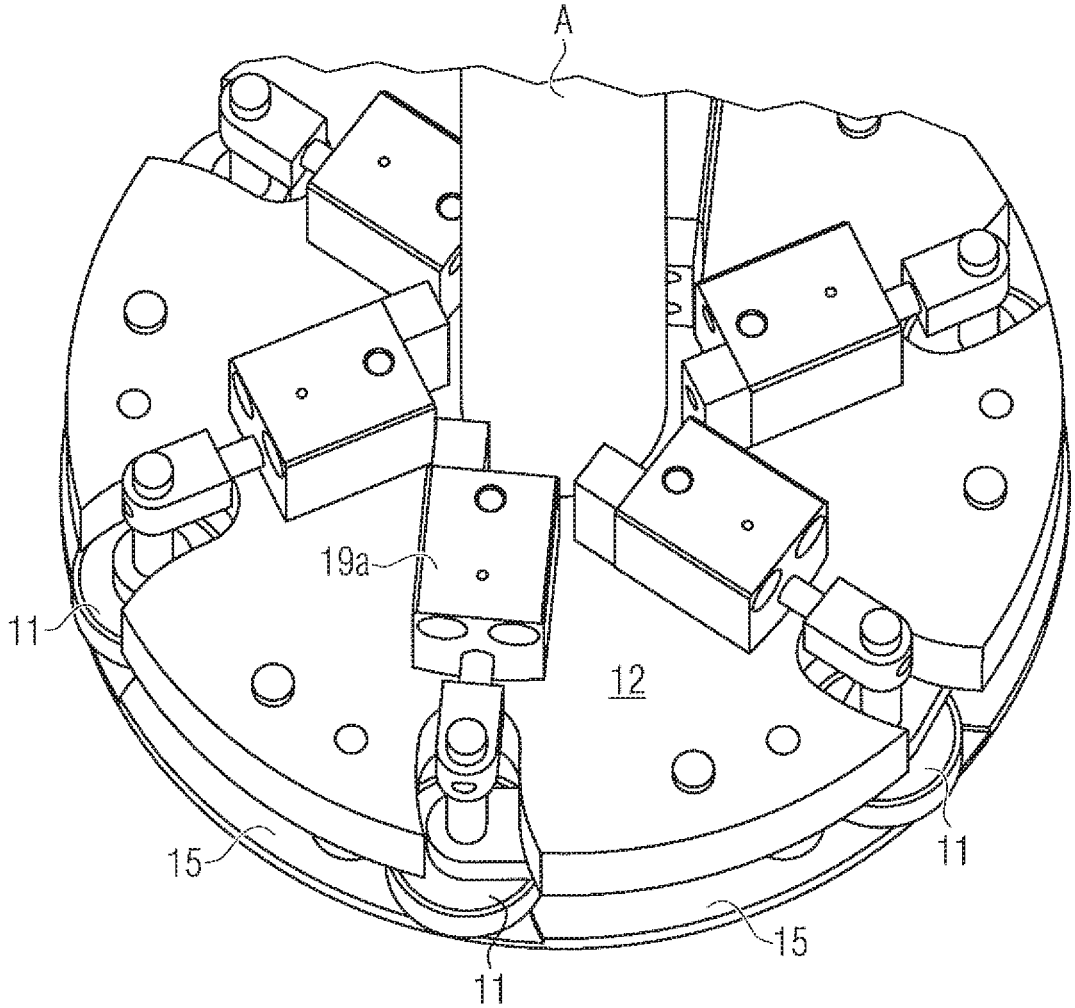
FIG. 3*a* shows a perspective representation of the tool 10 according to FIG. 3 obliquely from above, with the positioning means 15 for the closure. The elements are functionally identical and are here only shown more precisely as regards their geometry.

FIG. 3 shows an embodiment of the tool in a view obliquely from below (FIG. 3*a* obliquely from above). From this perspective, an optional positioning element 15 can be seen, which is arranged below the tool plate 12, so that the rolls 11 in the tool 10 are arranged axially between the positioning element 15 and the lower surface of the tool plate 12. The positioning element 15 is configured such that it is able to receive and hold a closure 3 (with panel 3*a* and rim 4). When the tool 10 moves into a receptacle 1, the closure 3 and the at least one roll 11 attached to the tool plate 12 are thus introduced in the receptacle 1 together therewith. This will save time during the closing process and error sources entailed by an additional operating step can be avoided.

The positioning element 15 has provided therein guide tracks 15*a*, which are open at the edge side and which extend in an arcuate shape (on a respective circular path about the respective joint 16 at the distance of the respective arm 16*a*). The rolls 11 can be guided in the guide tracks, when a respective lower pin 17*a* of the respective roll axil engages the respective track 15*a*.

Figure 4:
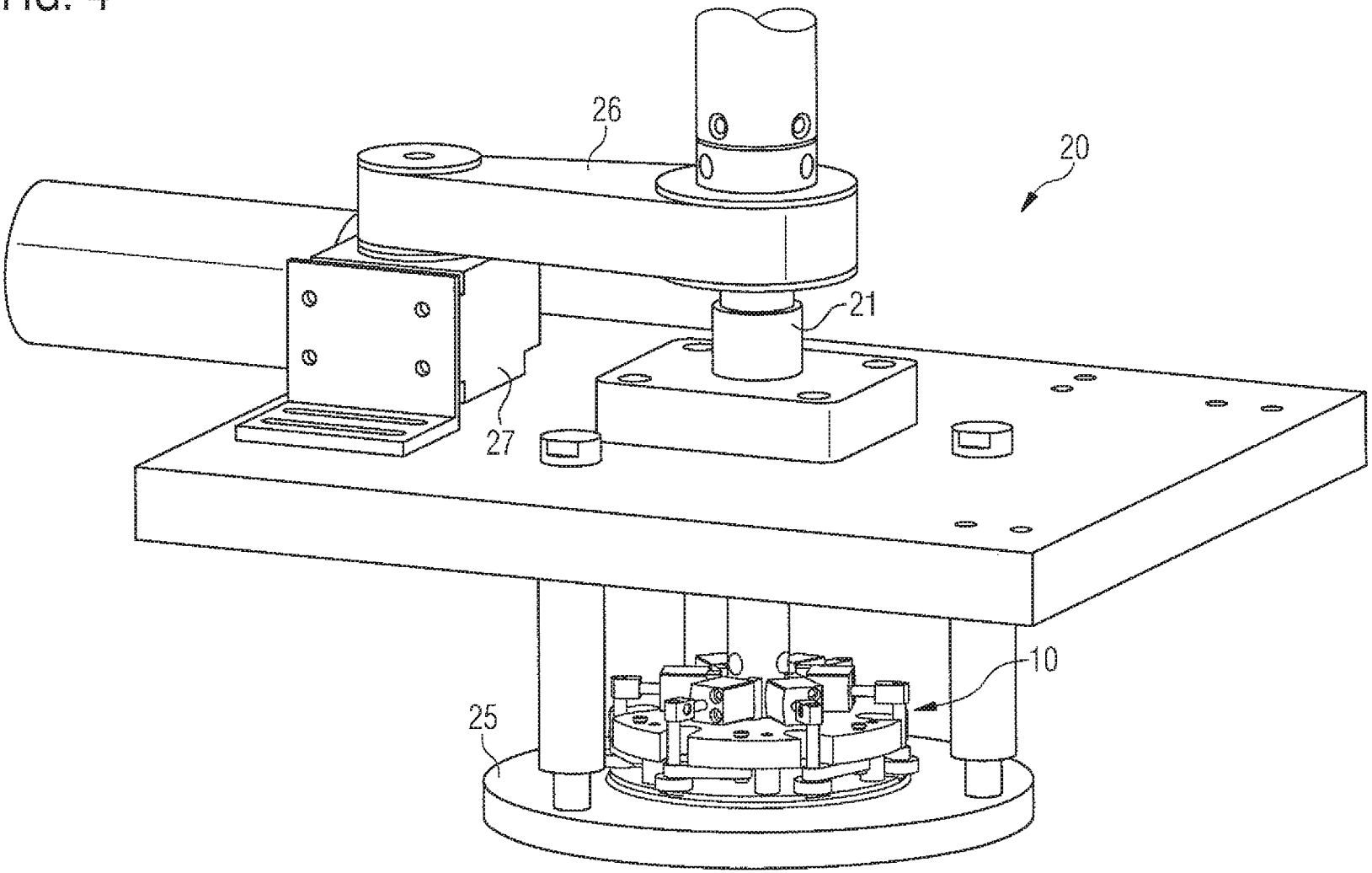
FIG. 4 shows, in a perspective representation, a closure assembly 20.

In FIG. 4, a closure assembly 20 is shown, which comprises a tool 10. The tool 10 has arranged thereon a shaft 21 such that the latter will be able to transmit a torque to the tool, which will cause the tool 10 to rotate. The movement is provided by a drive 27 and transmitted to the shaft 21 via a transmission element 26.

Figure 5:
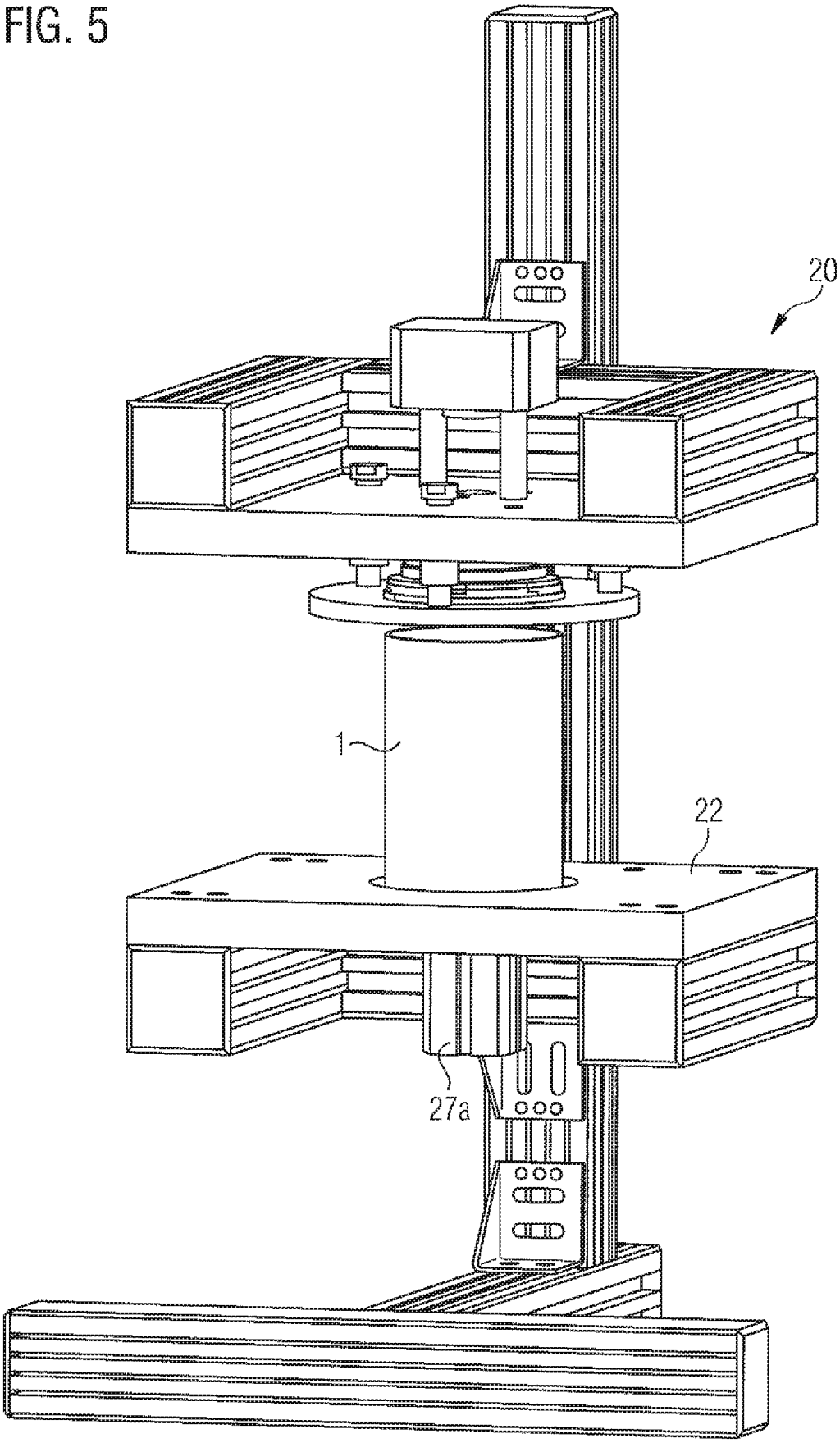
FIG. 5 shows, in a perspective representation, a closure assembly 20 with a receptacle 1 and a lifting device 22.

A further embodiment of a closure assembly is shown in FIG. 5. Here, a drive 27*a* is arranged on a lifting device 22, so that a rotation of the receptacle 1 will take place, when the tool 10 has been introduced in the receptacle. The tool does not rotate in this case, but a circumferential relative movement (of the rolls 11 and of the receptacle 1) is nevertheless accomplished.

Figure 6:
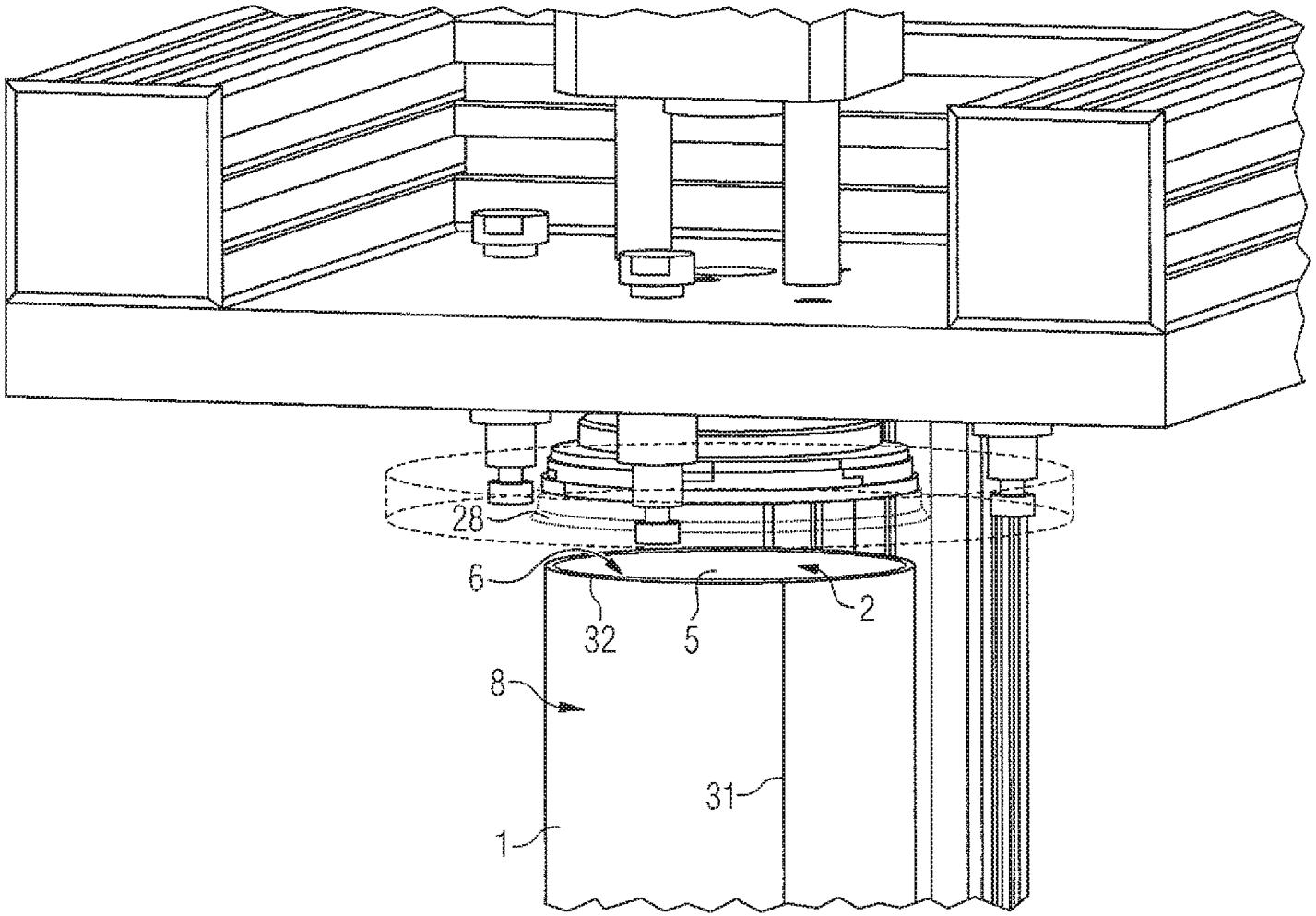
FIG. 6 shows, in a perspective detail representation, a closure assembly 20 with a receptacle 1.

FIG. 6 shows, independently of the embodiment of the closure assembly 20, the operating mode of a centering ring 25. The latter is configured as a ring and the lower inner edge thereof is provided with an upwardly directed chamfer 28, so that the circumference of the ring hole is smaller at the top than at the bottom, a receptacle 1 being moved from bottom to top in the direction of the centering ring 25. The chamfer 28 in the centering ring 25 has the effect that a receptacle 1 which is not positioned in a sufficiently precise manner is radially deflected through an axial movement by a movement of the centering ring 25 relative to the receptacle 1, until sufficient centering of the centering ring 25 and the receptacle 1 has been accomplished.

Since the centering ring 25 is arranged within the closure assembly 20 such that it is preferably centered with the tool 10, centering of the receptacle 1 and of the tool 10 will be guaranteed in this way.

In order to allow a receptacle 1 to be closed, the receptacle 1 should—in cases where the tool 10 rotates—be secured against rotation. In other words, a torque, which will inevitably be transmitted to the receptacle 1 when the tool 10 rotates with the roll 11 being in its deflected condition, must be taken up, since otherwise the receptacle 1 will rotate about its longitudinal axis during the closing process, and this, in turn, will have undesirable disadvantageous effects during closing. Therefore, the receptacle 1 is fixed, through a small force, between the chamfer 28 of the centering ring 25 and an element on which the receptacle 1 rests. At any rate, the force suffices to produce between the chamfer 28 of the centering ring 25 and the rim 32 of the receptacle and between the receptacle bottom and the element on which the receptacle is located, respectively, a frictional force that is able to counteract the torque during the dosing process, without a rotation of the receptacle 1 taking place.

Figure 6A:
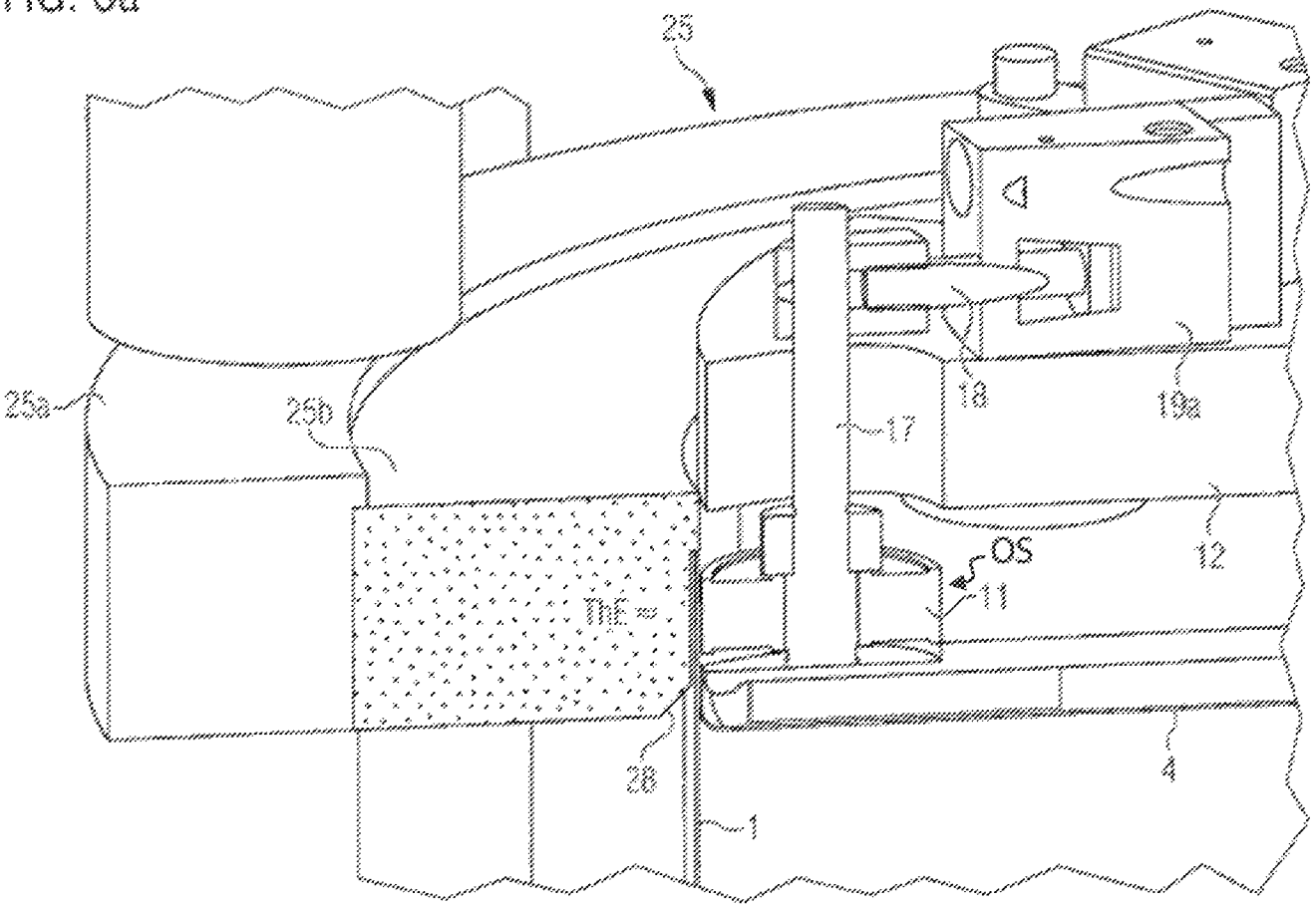
FIG. 6*a* illustrates the chamfer 28 according to FIG. 6, which centers the receptacle.

FIG. 6*a* illustrates the chamfer 28 on the inner, lower edge of the centering ring 25. The latter is here subdivided into two functional sections, an outer holding ring 25*a* and an inner ring 25*b* that emits thermal energy "thE" or magnetic fields towards the receptacle, so as to heat the fastening point or the layer 7.

Figure 7:
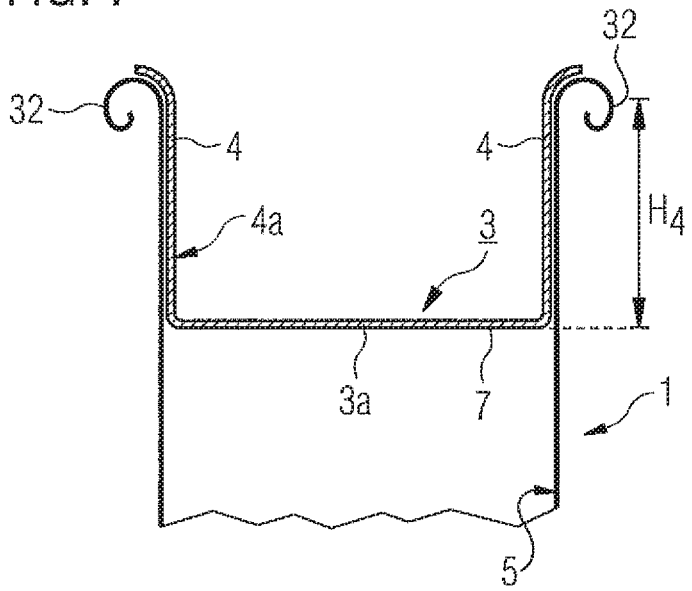
FIG. 7 shows, in a sectional view, a receptacle 1 whose single opening 2 is provided with a closure 3 on the inner side 5 of the receptacle.
Figure 7A:
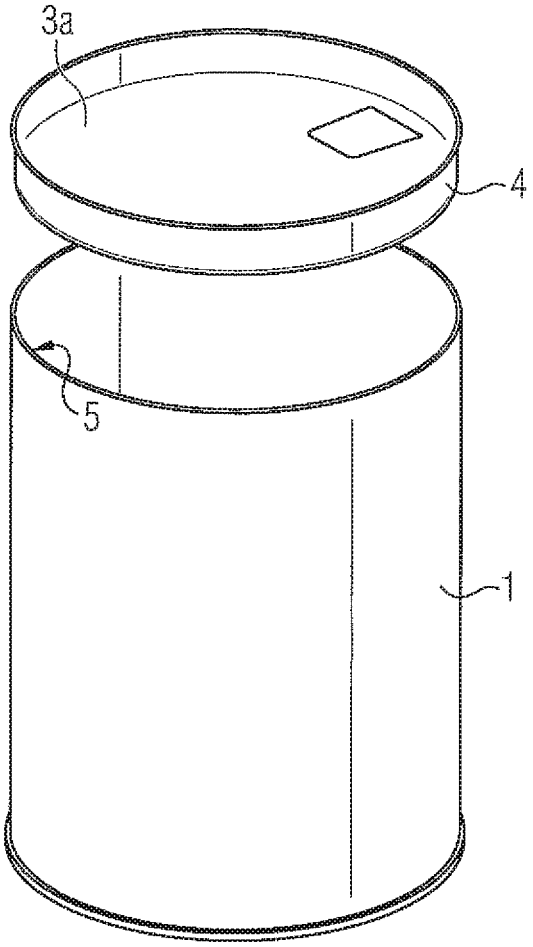
FIG. 7*a* shows, in a perspective view, the receptacle 1 with a closure 3 to be inserted. A pull tab 3*b* is attached to the bottom 3*a* of the closure 3 close to the rim 4.

FIG. 7 shows an embodiment of a receptacle 1. A closure 3 is connected via a closure rim 4 to the inner side 5 of a receptacle 1. Inside the receptacle 1, the whole area of the closure rim 4 is fixedly connected to e.g. the upper edge strip of the inner side of the receptacle. The area of the closure rim 4 results from the height H4 and from the circumference of the closure rim. The bottom of the closure 3 is the panel 3*a*.

Figure 8:
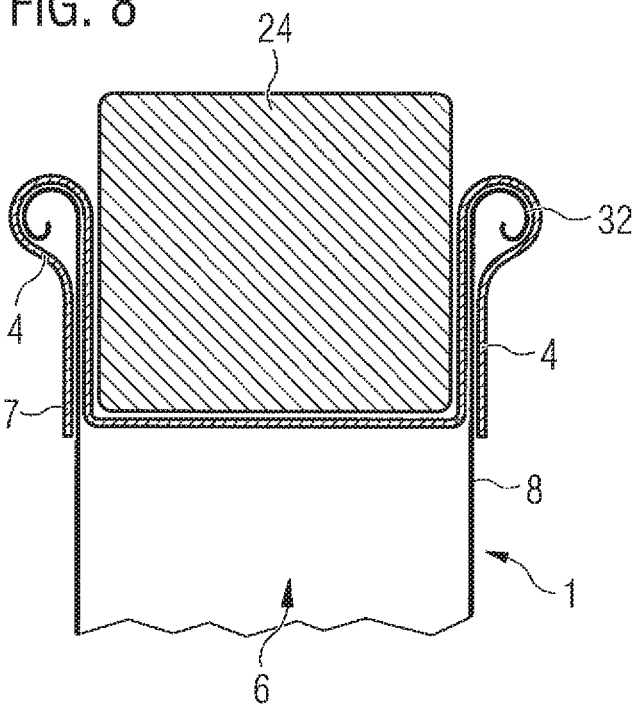
FIG. 8 shows, in a sectional view, a receptacle 1 whose single opening 2 is provided with a closure 3 on the outer side 8 of the receptacle.

Within the scope of the present invention, a connection of a closure 3 may just as well be attached to the outer side 8 of the receptacle. An embodiment of this type is shown in FIG. 8. In this case, the closure 3 is arranged in the interior 6 of the receptacle and a first area of the closure rim 4 contacts the inner side 5 of the receptacle. In addition, a second area of the closure rim 4 is arranged such that it lies on top of a rim 32 of the receptacle 1, and is fixedly connected to the outer side 8 of the receptacle. The height H4 of the closure rim 4 must be sufficiently large for encompassing an inner side 5 and an outer side 8 of the receptacle 1 (including the rim 32). The sealing of a thus configured, closed receptacle 1 is especially provided on the outer side 8 of the receptacle.

In order to produce such a result, it will suffice to reconfigure a tool 10 only insignificantly in such a way that a roll 11 will be able to apply a force radially from the outer to the inner side. Preferably, a receptacle 1 according to this embodiment is sealed by introducing a holding element 24 into the space of a receptacle 1 such that, while applying pressure to, and possibly heating, the closure rim 4 from outside the can, the closure 3 located inside will be stabilized.

To this end, the holding element 24 has a basic shape that corresponds to the basic shape of a receptacle 1 to be closed. The radial dimension of the basic shape of the holding element 24 is here slightly (less than 5%) smaller than the radial dimension of the basic shape of the receptacle 1, so as to allow the holding element 24 to be easily introduced in the space above the closure 3. The holding element 24 may here also fulfil the function of a positioning element 15, so that a closure 3 is introduced in a receptacle 1 by means of the positioning element 15 and the positioning element 15 remains, while the closure rim 4 is being pressed against the outer side 8 of the receptacle, at the position which it assumed for positioning the closure 3.

Quite generally, the suggested tools 10 or the closure assembly 20 with the tool 10 are adapted to be used, where appropriate, for closing various receptacles 1 according to the method described, in addition to differences between the respective materials, the receptacles 1 may also substantially differ from one another with respect to their shape; it is, for example, also possible to close not only cylindrical receptacles 1 but also oval or polygonal receptacles 1. The same applies to integrally formed and multipart receptacles 1 (such as three-part cans). During the closing process, a receptacle 1 to be closed has preferably already been filled with a product to be filled.

Depending on the material of the receptacle 1, different arrangements of a heating element 23 are preferably used. For example, according to a preferred embodiment, the heating element 23 is employed in the form of a heat radiator, e.g. as a laser or infrared radiator, acting from outside (outside of a receptacle 1), a course of action that is expedient especially in the case of metal receptacles. In the case of plastic receptacles 1 or receptacles 1 consisting of a composite material, the heating element 23 should preferably be arranged inside the tool 10 (between the area of the tool center and the roll 11).

When an inductive element is used, the roll 11 may be heated, which will then transfer the heat to the layer 7 to be softened. Also the closure 3, which preferably comprises a certain percentage of aluminum, may be heated by an inductive element used as a heating element 23. An electric element used as a heating element 23 may provide heat outside of the receptacle 1 in the case of receptacles 1 consisting of metal, this also applies to receptacles 1 made of glass. When the receptacle 1 in question consists of thermally sensitive materials, it is, as a matter of principle, preferred to provide heat from the inner area. If receptacles 1 are sealed on the outer side 8 of the receptacle, the preferred position of a heating element 23 reverses, so that positions preferred inside will be preferred outside and vice versa.

According to a further embodiment, a change in the direction of rotation of the roll 11 may be advantageous, so that, while the closure rim 4 is pressed against the inner side 5 or the outer side 8 of a receptacle 1, a clockwise movement of the roll 11 will take place, and when a closure rim 4 is pressed against a receptacle wall of a subsequent receptacle 1 an anticlockwise movement of the roll 11 will take place, or vice versa. Likewise, a direction of roll movement may be changed while a closure rim 4 is being pressed against a receptacle wall (inner side 5 and/or outer side 8) of a receptacle 1, so that a rotation of a tool 10 with the roll 11 will take place first in a clockwise direction and, on the same closure 3, subsequently in an anticlockwise direction, or vice versa.

Apart from fastening a closure 3 to a receptacle wall 5, 6 by means of a hot glue or a sealing wax, the closure rim 4 is thermally connected to a receptacle wall 5, 6 according to preferred embodiments of the invention. This may, for example, be done by soldering or welding.

According to a further embodiment, a closure assembly 20 may comprise a counterholder. The counterholder is attached to a side of a receptacle wall on which the roll 11 is not present. If a receptacle 1 is closed by connecting a closure rim 4 to an inner side 5 of the receptacle, the counterholder abuts on the associated outer side 8 of the receptacle. If a closure rim 4 is connected to an outer side 8 of the receptacle, the counterholder abuts on the associated inner side 5 of the receptacle. The counterholder is able to counteract a force, which acts via a roll 11 on a wall of a receptacle 1, whereby a possible deformation of the basic shape of the receptacle 1 can be prevented.

The invention claimed is:

1. A tool for closing an opening (2) of a receptacle (1) having a receptacle inner side (5) by a closure (3), the tool (10) comprising:

(a) a tool plate (12) that is adapted to be introduced in an opening (2) of the receptacle (1) to be closed;

(b) at least one roll (11) arranged on the tool plate (12) in a starting position (13), the at least one roll (11) being deflectable radially outwards to a closing position (14) and returnable to its starting position (13), so that a radial force can be caused to act on or can be applied to a closure rim (4) of the closure (3) for a limited period of time, the closure rim (4) being arranged between the at least one roll (11) and the receptacle inner side (5); and (c) wherein an outer surface of the at least one roll has a cylindrical shape with a constant diameter over its entire height to engage the closure rim.

2. The tool according to claim 1, wherein the tool plate (12) has arranged thereon two rolls (11), three rolls (11), four rolls (11), five rolls (11), six rolls (11), seven rolls (11), eight rolls (11) or more than eight rolls (11).

3. The tool according to claim 1, wherein the tool comprises a positioning element (15) for introducing the closure (3) into the receptacle (1).

4. The tool according to claim 1, wherein the at least one roll (11) is deflectable by a defined force.

5. An assembly comprising a tool for closing an opening (2) of a receptacle (1), having receptacle side wall inner side (5) comprising a vertically extending portion, and a shaft (21), the tool (10) comprising:

(a) a rotating tool plate (12) that is adapted to be introduced in an opening (2) of the receptacle (1) to be closed;

(b) at least one roll (11) having a constant diameter over a height thereof and being arranged on the rotating tool plate (12), wherein from a starting position (13), the at least one roll (11) being deflectable radially outwards to a closing position (14) and returnable to the starting position (13), to provide a radial force to a closure rim (4) of a closure (3) by the at least one roll (11) with the constant diameter of the height for a limited period of time; and (c) the closure rim (4) being arranged between the at least one roll (11) having the constant diameter and the vertically extending portion of the receptacle side wall inner side (5) and the closure rim contacting the vertically extending portion of the receptacle side wall inner side, when the radial force is applied;

wherein the shaft (21) is connected to the tool (10) to transmit a torque to the tool (10).

6. The assembly according to claim 5, wherein, in addition to transmitting a torque to the tool (10), the shaft (21) is also axially displaceable or extendable.

7. The assembly according to claim 5, comprising a lifting device (22) that is arranged such that a receptacle (1) with an opening (2) to be closed can rest thereon and that, through a movement of the lifting device (22), the tool (10) can be received by the receptacle (1) with the opening (2).

8. The assembly according to claim 5, comprising a heating element (23).

9. The assembly according to claim 8, wherein the heating element (23) is arranged between a centerline of the rotating tool plate (12) and the at least one roll (11) or is arranged radially outside of the receptacle (1).

10. The assembly according to claim 8, wherein the heating element (23) is configured as an induction element, as an electric heating element or as a heat radiator element.

11. The assembly according to claim 5, comprising a guide ring (25) and a lifting device (22), wherein the lifting device (22) is arranged such that a receptacle (1) with an opening (2) to be closed can rest thereon and that, through a movement of the lifting device (22), the receptacle (1) can be moved over the tool (10).

12. The assembly according to claim 11, wherein the guide ring (25) is able to receive the receptacle (1) therein such that the receptacle (1) occupies a defined position and is able to guide the receptacle over the tool (10) under preload of a spring.

13. A method of closing an opening (2) of a receptacle (1) having a receptacle side wall inner side (5) with a vertically extending portion and a receptacle interior (6), the method comprising the following steps:

(a) providing a receptacle (1) having at least one opening (2) to be closed;

(b) introducing a closure (3) into the opening (2) of the receptacle (1), the closure (3) having a closure rim (4) directed away from the receptacle interior (6), and an axial basic shape of the closure rim (4) corresponds to an axial basic shape of the receptacle (1);

(c) introducing a rotatable tool (10) into a space, open on one side thereof and delimited by the closure (3);

(d) deflecting at least one rotatable roll (11) having a constant diameter over a height thereof radially outwards, to-contact engaging the closure rim (4) of the closure (3); and (e) rotating, about a longitudinal axis, the rotatable tool (10), with the at least one rotatable roll (11) having the constant diameter of the height thereof engaging the closure rim (4), relative to the receptacle (1), or vice versa, and attaching the closure rim (4) to the vertically extending portion of the receptacle side wall inner side (5), to close the opening (2).

14. The method according to claim 13, wherein one side of the closure rim (4) has provided thereon a layer (7) that is brought into contact with the receptacle side wall inner side (5) and thermally liquefied before and/or while the rotatable tool (10) rotates relative to the receptacle (1), or vice versa.

15. The method according to claim 14, wherein thermal energy for liquefying the layer is transferred to the layer by heating at least one rotatable roll (11) and/or the receptacle (1) and/or the closure.

16. The method according to claim 13, wherein the closure (3) is introduced in the receptacle (1) via a positioning element (15) arranged on the rotatable tool (10).

17. The method according to claim 13, wherein, due to the rotation of the rotatable tool (10) or of the receptacle (1), the at least one rotatable roll (11) engaging the closure rim (4) rotates in a clockwise direction or in a counter-clockwise direction, so that the at least one rotatable roll (11) moves in a direction opposite to an upwardly formed step in a receptacle side wall.

18. The method according to claim 13, wherein, due to the rotation of the rotatable tool (10) or of the receptacle (1), the at least one rotatable roll (11) contacting the closure rim (4) rotates in a clockwise direction or in a counter-clockwise direction, so that the at least one rotatable roll (11) moves in a direction opposite to a downwardly formed step in a receptacle side wall.

19. A method of closing an opening (2) of a receptacle (1) having a receptacle inner side (5) and a receptacle interior (6) encompassed by the inner side as an inner surface, the method comprising the following steps:

(a) the receptacle (1) providing at least one opening (2) to be closed;

(b) introducing a closure (3) into the opening (2) of the receptacle (1), the closure (3) having a closure rim (4) directed away from the receptacle interior (6) and a closure panel (3*a*), whose circumferential basic shape corresponds to a circumferential basic shape of the receptacle (1) in at least an upper section thereof;

(c) axially introducing a closure tool (10) into a space open on one side thereof and delimited by the closure panel (3*a*) on an opposite side thereof;

(d) outwardly deflecting at least one rotatable roll (11), wherein the at least one rotatable roll has a cylindrical shape with a constant diameter over its entire height, engaging the closure rim (4) of the closure (3) with the cylindrical shape; and (e) applying a rotating movement of the closure tool (10) and the at least one rotatable roll (11) relative to the receptacle (1), to attach the closure rim (4) to the receptacle inner side (5), tightly closing the opening (2).

20. The method according to claim 19, wherein one side of the closure rim (4) has provided thereon a layer (7), the layer (7) being brought into contact with the receptacle inner side (5) and thermally at least softened before and/or during the rotating movement.

21. The method according to claim 20, wherein a thermal energy for liquefying the layer (7) is transferred to the layer by heating the at least one rotatable roll (11) and/or an upper section of the receptacle (1) and/or the closure (3).

22. The method according to claim 19, wherein the closure (3) is introduced in the receptacle (1) by a positioning element (15) arranged on the closure tool (10), the closure tool (10) and the closure (3) being-introduced in the receptacle (1) simultaneously.

23. The method according to claim 19, wherein, due to the relative movement of the closure tool (10) and of the receptacle (1), the at least one rotatable roll (11) contacting the closure rim (4) is rotatingly driven such that the at least one rotatable roll (11) moves towards an upwardly formed step (31) in a receptacle side wall.

24. The method according to claim 19, wherein, due to the relative movement of the closure tool (10) and of the receptacle (1), the at least one rotatable roll (11) engaging the closure rim (4) is rotatingly driven such that the at least one rotatable roll (11) moves towards a downwardly formed step in a receptacle side wall.

25. The method according to claim 19, wherein in feature (e) the closure rim (4) is fastened to an upper end section of the receptacle inner side (5) and the opening (2) of the receptacle (1) is tightly closed.

* * * * *